US006568679B1

(12) United States Patent
Sommer

(10) Patent No.: US 6,568,679 B1
(45) Date of Patent: May 27, 2003

(54) CUBICAL MAZE MODULE

(76) Inventor: Michael Saunders Sommer, 2401 Pennsylvania Av. Apt. 19A12, Philadelphia, PA (US) 19130

( * ) Notice: Subject to any disclaimer, the term of this patent is extended or adjusted under 35 U.S.C. 154(b) by 0 days.

(21) Appl. No.: 09/616,322

(22) Filed: Jul. 15, 2000

Related U.S. Application Data

(60) Provisional application No. 60/146,652, filed on Jul. 30, 1999.

(51) Int. Cl.[7] ..... A63F 7/04

(52) U.S. Cl. ..... 273/153 R; 273/118 R

(58) Field of Search ..... 273/153 R, 118 R, 273/123 R, 113, 109, 115, 116, 117, 118

(56) References Cited

U.S. PATENT DOCUMENTS

| | | | | | |
|---|---|---|---|---|---|
| 3,069,805 | A | * | 12/1962 | Burrows | 273/153 R |
| 3,696,549 | A | * | 10/1972 | Zilius | 273/153 R |
| 3,787,054 | A | | 1/1974 | Stafford | 273/109 |
| 4,005,865 | A | * | 2/1977 | Kidder | 273/153 R |
| 4,008,895 | A | * | 2/1977 | Reiner et al. | 273/113 |
| 4,494,753 | A | | 1/1985 | Wampler | 273/11 |
| 4,545,577 | A | | 10/1985 | Randleman | 273/113 |
| 4,553,749 | A | | 11/1985 | Bender et al. | 273/1 R |
| 4,743,023 | A | | 5/1988 | Collier | 273/153 |
| 4,824,098 | A | | 4/1989 | Huang | 273/113 |
| 4,861,036 | A | | 8/1989 | Watanabe | 273/113 |
| 4,953,502 | A | | 9/1990 | Hoover | 273/153 |
| 4,953,863 | A | | 9/1990 | Zeidler et al. | 273/113 |
| 5,042,808 | A | | 8/1991 | Shoptaugh | 273/110 |
| 5,145,174 | A | | 9/1992 | Caramanoff | 273/109 |
| 5,560,606 | A | | 10/1996 | David | 273/153 R |
| 5,711,744 | A | | 1/1998 | Strawcutter et al. | 482/35 |

* cited by examiner

*Primary Examiner*—Steven Wong

(57) ABSTRACT

A cubical maze module, counterintuitive in operation, consisting of a hollow cubical box having six transparent walls with eight circular openings of the same diameter; the walls defining four tortuous conduits, each extending from and between a circular opening, eccentrically located, in the center of one quadrant of a wall, and a circular opening, eccentrically located, in the center of one quadrant of an adjacent wall; the tortuous conduits forming passageways for a ball. No matter which side is up, on a horizontal surface, the ball is always able to traverse a plurality of tortuous conduits, under gravity, while not able to traverse one or two other tortuous conduits, as the module is manipulated about the three-dimensional axes. A cubical maze module can be used singly, or as a plurality of identical cubical maze modules which are interchangeable; with each additional module the tortuous conduits can be linked to allow passage of the ball through progressively longer and exponentially more complex combinations of paths; it is possible for up to four paths to cross within one cubical maze module.

3 Claims, 4 Drawing Sheets

CUBICAL MAZE MODULE

This application claims the benefit of provisional application No. 60/146,652, filed Jul. 30, 1999.

BACKGROUND OF THE INVENTION

A cubical maze module, counterintuitive in operation, consisting of a hollow cubical box having six transparent walls with eight circular openings of the same diameter; the walls defining four tortuous conduits, each extending from and between a circular opening, eccentrically located, in the center of one quadrant of a wall, and a circular opening, eccentrically located, in the center of one quadrant of an adjacent wall; the tortuous conduits forming passageways for a ball. No matter which side is up, on a horizontal surface, the ball is always able to enter and exit a plurality of tortuous conduits, under gravity, while not able to exit one or two other tortuous conduits, as the module is manipulated about the three-dimensional axes. A cubical maze module can be used singly, or as a plurality of identical cubical maze modules which are interchangeable; with each additional module the tortuous conduits can be linked to allow passage of the ball through progressively longer and exponentially more complex combinations of paths; it is possible for up to four paths to cross within one cubical maze module.

The use of maze puzzles is known in the prior art. Usually such devices involve the exercise of some skill and/or manual dexterity to manipulate the device to cause the ball to follow a given passageway, or to assemble the tortuous conduits in a desired way to vary the directions of the passageway. More specifically, maze puzzles heretofore devised are known to consist basically of familiar, expected, and obvious structural configurations, notwithstanding the myriad of designs encompassed by the crowded prior art which have been developed for the fulfillment of countless objectives and requirements.

By way of example:

- U.S. Pat. No. 3,406,971 to Koff discloses an example of labyrinth amusement device.
- U.S. Pat. No. 3,609,805 to Burrows discloses a game having sections of tortuous conduit and a plurality of supporting blocks which may be assembled to form a continuous passage that runs in varying directions.
- U.S. Pat. No. 3,696,549 to Zilius discloses ball and cube with tortuous conduits through which a ball may travel.
- U.S. Pat. No. 3,787,054 to Stafford discloses a hidden maze puzzle.
- U.S. Pat. No. 4,553,749 to Bender et al. discloses a game apparatus.
- U.S. Pat. No. 4,861,036 to Watanabe discloses multilevel crossing maze cubes.
- U.S. Pat. No. 4,953,863 to Zeidler et al discloses game assembly cubes.
- U.S. Pat. No. 4,743,023 to Collier discloses maze game modules.

However, those heretofore available possesses numerous drawbacks and disadvantages in that the structure allows none, or only limited and superficial variations of Complexity: variable ball path or route through rotation; adjustable level of complexity; linkable tortuous conduits which allow passage of the ball through progressively longer and exponentially more complex path combinations; paths with common crossing points; up to four paths which can cross within one device; and of General Modus Operandi of the device: operates both as a single device and a plurality of identical devices which are interchangeable.

Therefore, while these devices fulfill their respective, particular objectives and requirements, the aforementioned patents do not offer a cubical maze module, counterintuitive in operation, consisting of a hollow cubical box having six transparent walls with eight circular openings of the same diameter; the walls defining four tortuous conduits, each extending from and between a circular opening, eccentrically located, in the center of one quadrant of a wall, and a circular opening, eccentrically located, in the center of one quadrant of an adjacent wall; the tortuous conduits forming passageways for a ball. No matter which side is up, on a horizontal surface, the ball is always able to enter and exit a plurality of tortuous conduits, under gravity, while not able to exit one or two other tortuous conduits, as the module is manipulated about the three-dimensional axes. A cubical maze module can be used singly, or as a plurality of identical cubical maze modules which are interchangeable; with each additional module the tortuous conduits can be linked to allow passage of the ball through progressively longer and exponentially more complex combinations of paths; it is possible for up to four paths to cross within one cubical maze module.

In this regard, the cubical maze module, according to the present invention, substantially departs from the conventional concepts and designs of the prior art.

BRIEF SUMMARY OF THE INVENTION

In the view of the foregoing disadvantages inherent in the known types of maze puzzles now present in the prior art, the present invention provides a new and improved cubical maze module and method which has all the advantages of the prior art and none of the disadvantages.

To attain this, the present invention entails a cubical maze module, counterintuitive in operation, consisting of a hollow cubical box having six transparent walls with eight circular openings of the same diameter; the walls defining four tortuous conduits, each extending from and between a circular opening, eccentrically located, in the center of one quadrant of a wall, and a circular opening, eccentrically located, in the center of one quadrant of an adjacent wall; the tortuous conduits forming passageways for a ball. No matter which side is up, on a horizontal surface, the ball is always able to enter and exit a plurality of tortuous conduits, under gravity, while not able to exit one or two other tortuous conduits, as the module is manipulated about the three-dimensional axes. A cubical maze module can be used singly, or as a plurality of identical cubical maze modules which are interchangeable; with each additional module the tortuous conduits can be linked to allow passage of the ball through progressively longer and exponentially more complex combinations of paths; it is possible for up to four paths to cross within one cubical maze module.

The foregoing and other objects which will appear as the nature of the invention is better understood, may be accomplished by a construction, combination and arrangement of parts such as is disclosed by the drawings. The nature of the invention is such as to render it susceptible to various changes and modifications, and therefore is not limited to the construction described by the drawings nor to the particular parts described in the specification.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is neither intended to define the invention of the application, which is measured by the claims, nor is it intended to be limiting as to the scope of the invention in any way.

Therefore, it is an object of the present invention to provide a cubical maze module which has all the advantages of the prior art maze puzzles and none of the disadvantages.

It is another object of the present invention to provide a cubical maze module which may be easily and efficiently manufactured and marketed.

These together with other objects of the invention, along with the various features of novelty which characterize the invention, are pointed out in the claims forming a part of this disclosure. For a better understanding of the invention, its operating advantages and the specific objects attained by its uses, the accompanying drawings and descriptive matter illustrates the preferred embodiment of the invention.

BRIEF DESCRIPTION OF THE SEVERAL VIEWS OF THE DRAWING

The invention will be better understood when consideration is given to the following detailed description of the annexed drawings:

| | |
|---|---|
| cubical maze modules | 10a, 10b, 10c, 10d |
| walls | 12a, 12b, 12c, 12d, 12e, 12f |
| openings | 14a, 14b, 14c, 14d, 14e, 14f, 14g, 14h |
| tortuous conduits | 16a, 16b, 16c, 16d |
| linked tortuous conduits | 18a, 18b, 18c |
| entrance | 20 |
| exit | 22 |
| ball | 24 |

Figure 1:
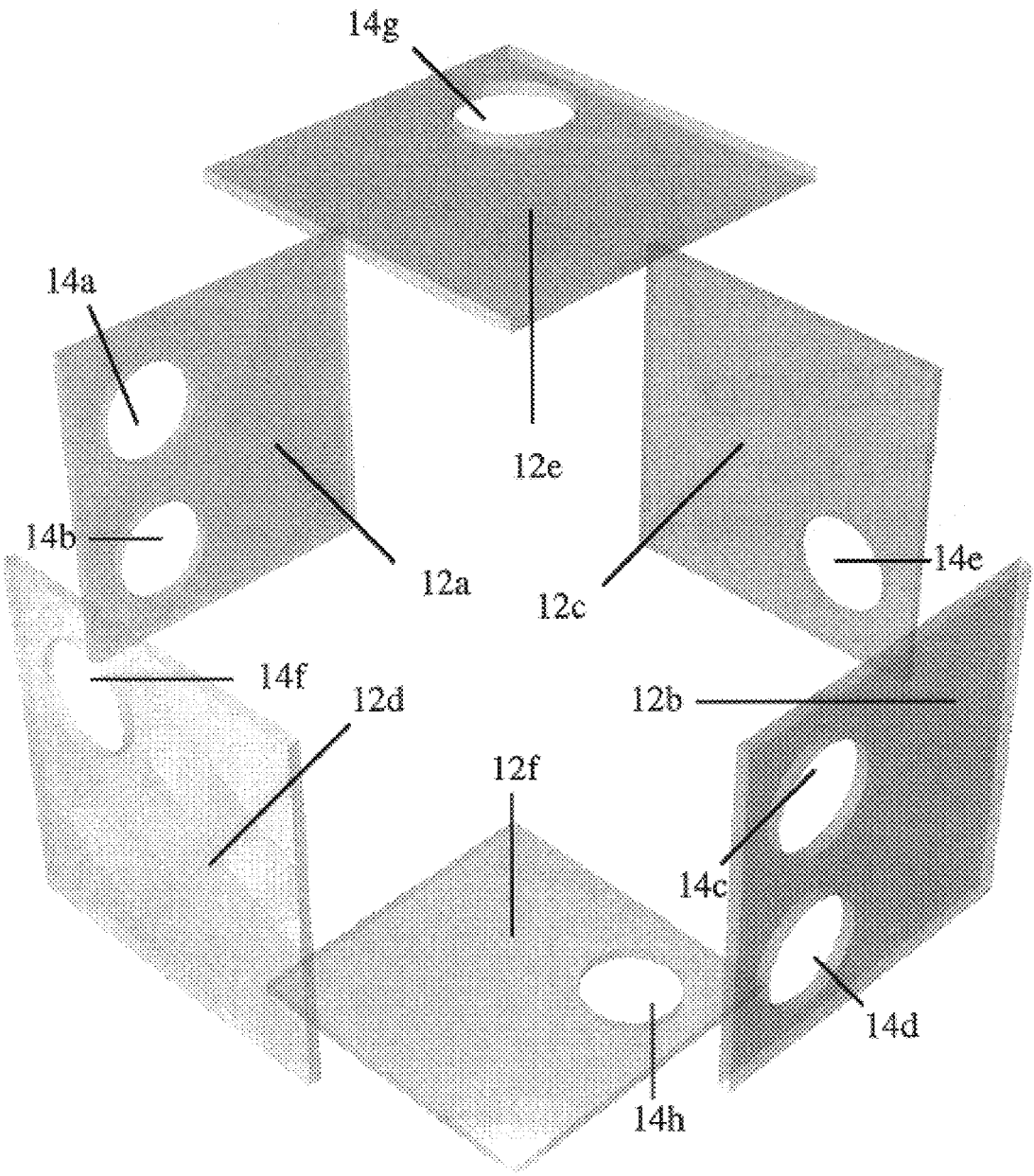

FIG. 1 is an exploded perspective view of the openings, relative to the sides, of the cubical maze module.

Figure 2:
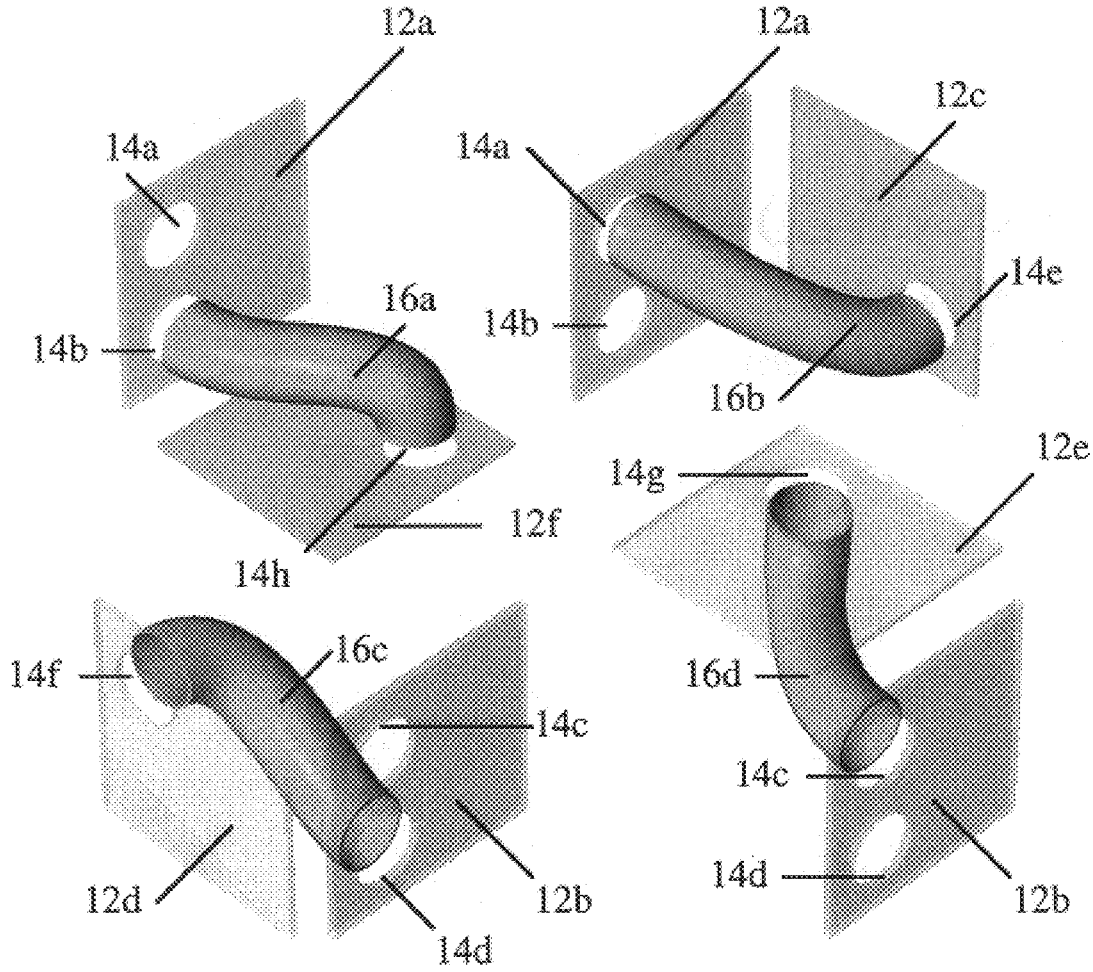

FIG. 2 is an exploded perspective view of the tortuous conduits and the openings, relative to the sides of the cubical maze module.

Figure 3:
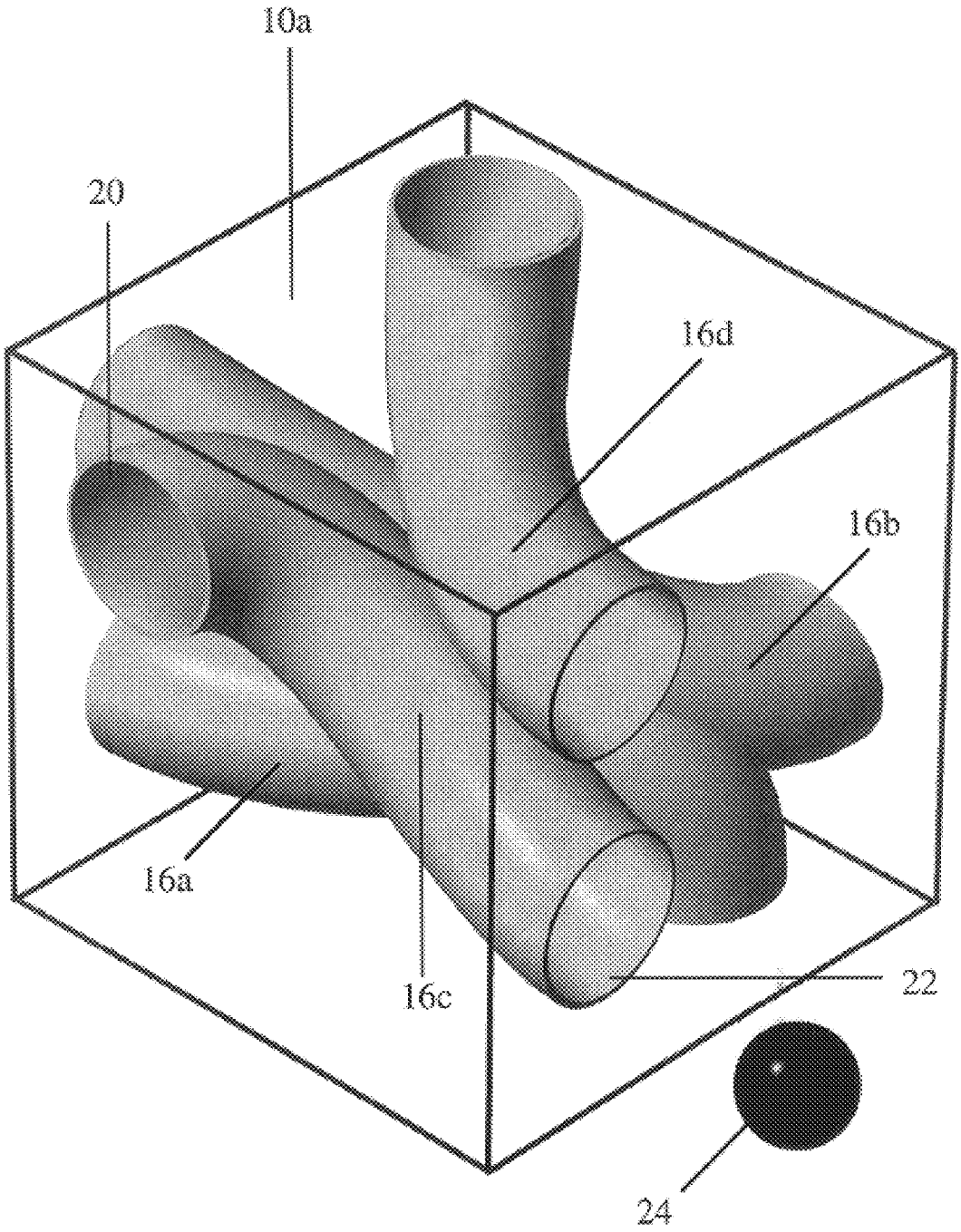

FIG. 3 is a perspective view of the cubical maze module.

Figure 4:
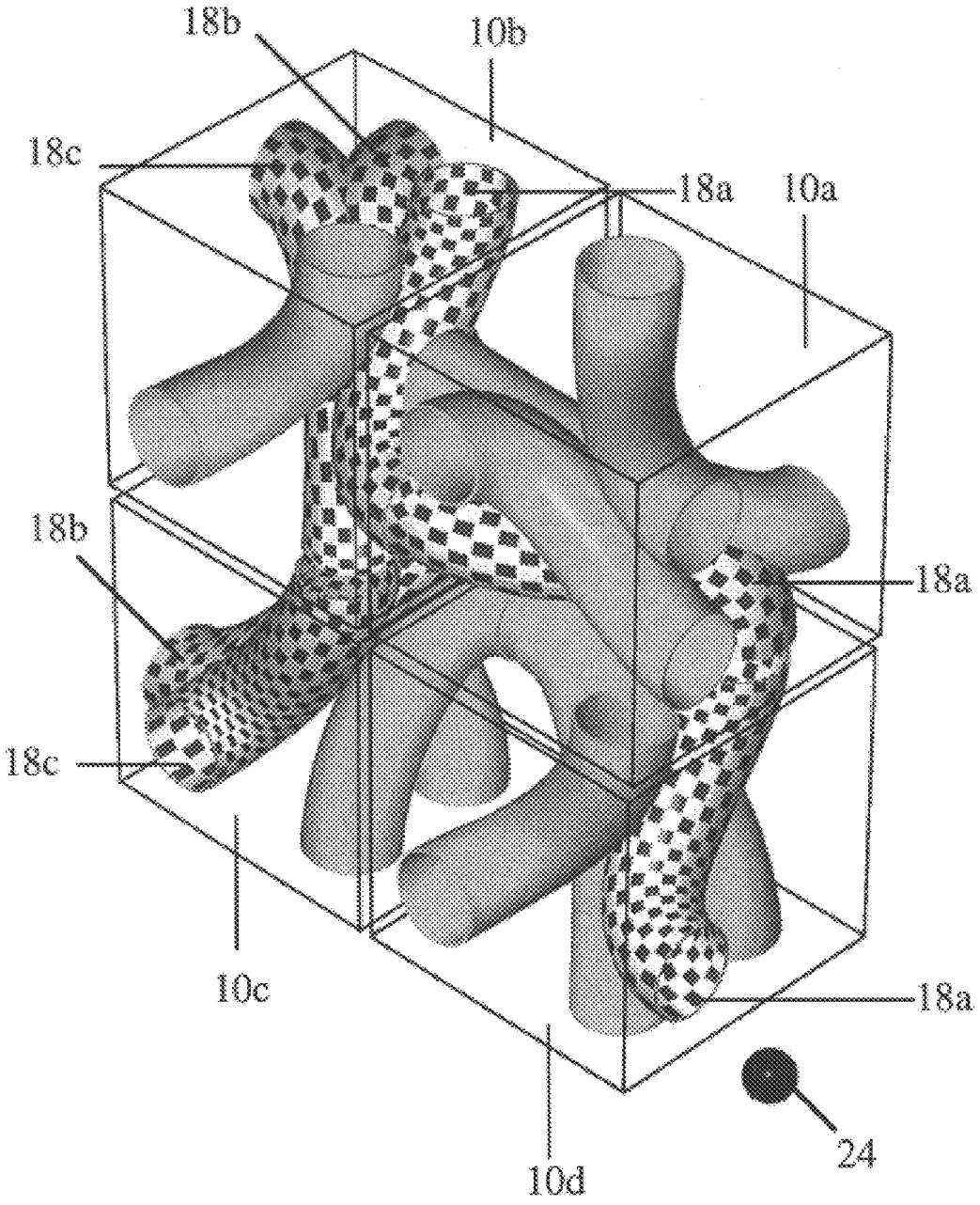

FIG. 4 is a perspective view of four cubical maze modules with linked tortuous conduits.

The same reference numerals refer to the same parts through the various Figures.

DETAILED DESCRIPTION OF THE INVENTION

With reference now to the drawings, FIGS. 1–4, the cubicle maze module will be described: As shown in FIG. 1, six transparent walls 12*a*, 12*b*, 12*c*, 12*d*, 12*e*, and 12*f*, of a cubical maze module, with eight circular openings 14*a*, 14*b*, 14*c*, 14*d*, 14*e*, 14*f*, 14*g*, and 14*h* of the same diameter. As shown in FIG. 2, the walls defining four tortuous conduits 16*a*, 16*b*, 16*c*, and 16*d*, each extending from and between a circular opening 14*a*, 14*b*, 14*c*, 14*d*, 14*e*, 14*f*, 14*g*, and 14*h*, eccentrically located, in the center of one quadrant of a wall, and a circular opening, eccentrically located, in the center of one quadrant of an adjacent wall; more specifically, tortuous conduit 16*a* extends from hole 14*b* in wall 12*a* to hole 14*h* in wall 12*f*; tortuous conduit 16*b* extends from hole 14*a* in wall 12*a* to hole 14*e* in wall 12*c*; tortuous conduit 16*c* extends from hole 14*f* in wall 12*d* to hole 14*d* in wall 12*b*; tortuous conduit 16*d* extends from hole 14*g* in wall 12*e* to hole 14*c* in wall 12*b*; the tortuous conduits forming passageways for a ball 24. As shown in FIG. 3, a cubical maze module 10*a*, where no matter which side is up, on a horizontal surface, the ball is always able to enter and exit a plurality of tortuous conduits 16*b*, 16*c*, and 16*d*, under gravity, while not able to exit one or two other tortuous conduits 16*a*, as the module is manipulated about the three-dimensional axes; the user simply places the ball 24 into an opening designated as the entrance 20 with the objective of ejecting the ball through an opening designated as the exit 22. As shown in FIG. 3, 10*a* a cubical maze module can be used singly, or as a plurality of identical cubical maze modules FIG. 4, 10*a*, 10*b*, 10*c*, and 10*d* which are interchangeable; with each additional module 10*b*, 10*c*, and 10*d* to the original cubical maze module 10*a*, the tortuous conduits 16*a*, 16*b*, 16*c*, and 16*d* of each module can be linked to allow passage of the ball through progressively longer and exponentially more complex combinations of paths 18*a*, 18*b*, and 18*c*. In this manner, two paths 18*b* and 18*c* cross within two cubical maze modules 10*b* and 10*c*, and three paths 18*a*, 18*b*, and 18*c* cross within another module 10*b*; it is possible for up to four paths to cross within one cubical maze module.

As to the manner of usage and operation of the present invention, the same should be apparent from the above description. Accordingly, no further discussion relating to the manner of usage and operation will be provided.

With respect to the above description, the optimum dimensional relationships for the parts of the invention, to include variations in size, opacity, materials, shape, form, function and the manner of operation, assembly and use, are deemed readily apparent and obvious to one skilled in the art, and all equivalent relationships to those illustrated in the drawings and described in the specification are intended to be encompassed by the present invention.

What I claim is:

1. A cubical maze module according to claim 1 wherein the openings are circular and the tortuous conduits are of circular cross-section.

2. A cubical maze module according to claim 1 wherein the tortuous conduits are of circular cross-section.

3. The cubical maze module according to claim 1 wherein additional identical maze modules are provided to link the tortuous conduits to allow passage of the ball through progressively longer and exponentially more complex combinations of paths.

* * * * *

UNITED STATES PATENT AND TRADEMARK OFFICE

CERTIFICATE OF CORRECTION

PATENT NO. : 6,568,679 B1
APPLICATION NO. : 09/616322
DATED : May 27, 2003
INVENTOR(S) : Michael Saunders Sommer It is certified that error appears in the above-identified patent and that said Letters Patent is hereby corrected as shown below:

Col. 4, lines 51-57, should read,

1. A cubical maze module, consisting of:
A hollow box having six transparent walls with eight circular openings of the same diameter;
the walls defining four tortuous conduits, each extending from and between a circular opening, eccentrically located, in the center of one quadrant of one wall, and a circular opening, eccentrically located, in the center of one quadrant of an adjacent wall;
The tortuous conduits forming passageways for a ball; and
A ball having a diameter smaller than the inner dimension of the tortuous conduits, adapted to be inserted in the openings of the tortuous conduits, and to travel along and exit the tortuous conduits.

Signed and Sealed this

Twentieth Day of May, 2008

JON W. DUDAS
*Director of the United States Patent and Trademark Office*